United States Patent [19]

Lipscomb et al.

[11] Patent Number: 4,610,897

[45] Date of Patent: Sep. 9, 1986

[54] RECOVERY OF FUGITIVE DUST

[75] Inventors: Robert L. Lipscomb, Westminster, Calif.; Virgil H. Cargle, Houston, Tex.; Domenick Bausano, Fountain Valley, Calif.

[73] Assignee: Exxon Chemical Patents Inc., Florham Park, N.J.

[21] Appl. No.: 697,307

[22] Filed: Feb. 1, 1985

[51] Int. Cl.[4] ..... B05D 7/00

[52] U.S. Cl. ..... 427/212; 427/214; 427/222

[58] Field of Search ..... 427/212, 214, 222

[56] References Cited

U.S. PATENT DOCUMENTS

| | | | |
|---|---|---|---|
| 2,609,305 | 9/1952 | Roediger | 427/214 X |
| 3,900,611 | 8/1975 | Corbett et al. | 427/214 |
| 4,428,984 | 1/1984 | Shimizu et al. | 427/212 X |
| 4,535,005 | 8/1985 | Haas et al. | 427/212 |

*Primary Examiner*—Thurman K. Page

*Attorney, Agent, or Firm*—R. A. Dexter; R. L. Graham

[57] ABSTRACT

A method for the recovery of fugitive dust by encapsulation of fugitive calcined coke dust into agglomerate balls having substantial compressive strength which involves the steps of water-wetting calcined coke dust with an aqueous solution of a polyethoxylated alkyl phenol wetting agent to provide moist coke dust and thereafter admixing the moist dust with an asphalt emulsion whereby nonfriable agglomerate balls of asphalt encapsulated calcined coke dust can be recovered.

12 Claims, No Drawings

RECOVERY OF FUGITIVE DUST

This invention relates to the recovery of fugitive dust. More particularly this invention relates to the agglomeration of fugitive dust and its recovery from the ambient environment.

BACKGROUND OF THE INVENTION

The prevention and/or recovery of many types of fugitive dust occurring in industrial practices is of wide spread concern in today's society. Typical fugitive dusts are those of coal, cement, fly ash and minerals that are emitted to atmosphere by industrial activity including mining, transportation and manufacturing.

Fugitive dust is of much concern underground in mining operations such as in coal mines where it is known to lay such fugitive coal dust by spraying with aqueous systems containing chemical additives to improve working conditions and reduce the toxicological risks and explosion hazards. Most commonly used chemical additives are hydroscopic salt mixtures or surfactants (United Kingdom Pat. No. 677279 describes the use of aqueous systems containing alkyl benzene sulphonates; U.S. Pat. No. 3,900,611 utilizes the combination of an amphoteric surfactant with a sulfosuccinate surfactant in an aqueous solution of a polymer such as polyacrylamide; and, U.S. Pat. No. 4,425,252 describes the combination of sodium dodecylbenzene sulfonate and a polyethoxylated nonylphenol in water as a means for the rapid abatement of respiratory coal dust).

Above ground, the generation of fugitive dust arising out of coal fines in the surface handling of bulk coal, particularly in its transport, is of much public concern. When coal is being transported in open top gondola cars in unit trains under drying weather conditions, wind action due to rapid movement of the train tends to blow dust off the surface unless some means of retarding this action is provided. Settling of fugitive coal dust near the railway tracks, particularly in populated areas, is objectionable. As much as 45% of the coal that is handled in this way may be finer than 28 mesh. It has been proposed that the open top gondola cars be provided with covers to protect the coal against wind action. Use of fiberglass lids on cars carrying metal concentrates is known. Such lids add substantially to the tare weight of each shipment and their removal before dumping and filling of the cars requires much labor or elaborate mechanical equipment. For coal, the cost of covering is very high in relation to the value of the product shipped. An alternative is the laying of fugitive coal dust by coating of bulk coal with oils and binders as is illustrated by:

U.S. Pat. No. 2,431,891 which spray coats coal with an aqueous colloidal suspension of asphalt to render the coal substantially dustproof;

U.S. Pat. No. 4,169,170 which treats coal in open top hopper cars with asphalt emulsions or pulp mill black liquor compositions to reduce losses in transit due to the action of wind on the coal surface by realizing a coating depth penetration of from 6.4 to 15 cm, whereby a flexible crust of oily adhesiveness is realized; and, U.S. Pat. No. 4,264,333 which covers the exposed surface of bulk or piled-up coal with a flexible, water resistant and force resistant blanket of coal tar by a two step operation in which the exposed surface of the coal is prewetted with a wetting agent and immediately thereafter the coal tar emulsion is sprayed on the coal.

The principal means relied on for abatement of particulate emissions, including fugitive dust, from manufacturing facilities are cyclones, electrostatic precipitators, fabric filters, and scrubbers. The widely used fabric filter systems, i.e., bag houses, usually consist of tubular bags made of woven synthetic fabric or fiberglass, in which the dirty gases pass through the fabric while the particles are collected on the upstream side by the filtering action of the fabric whereby the fugitive dust is removed from the ambient environment. The fugitive dust retained on the bags is periodically shaken off and falls into a collecting hopper for recovery. Bag houses provide high collection efficiency (an essential under current environmental laws) with wide application in many industries, including mining operations, food processing, grain elevators, soap and detergents, plastics manufacture, manufacture of carbon black and cement, and used in combination with the operation of electric arc furnace, foundry cupolas and nonferrous smelters.

Unfortunately, in addition to the disadvantages of high initial cost and high maintenance costs for bag replacement, removal and disposal of the retained dust without regeneration of fugitive dust is difficult to impossible and remains a critical problem requiring a solution.

Illustrative of a particularly difficult fugitive dust problem is that which arises out of the handling of calcined coke. Coke is a carbonaceous material obtained from the carbonization of coal or refinery crude oil bottoms into particulate solids useful for iron ore sintering, boiler firing, electric smelting, chemicals manufacturing and other purposes. Most coke producers market several coke sizes which involve crushing followed by screening separation into the desired sizes. The resulting sized green coke is subjected to calcination when it is desired to produce a densified coke of high purity as is required for its processing into a carbon electrode useful for metallurgical applications. The calcined coke is maintained in a closed environment during its crushing, screening, storage and transport. Since the particulate calcined coke is fragile, its movement generates calcined coke dust that is collected through an air recovery/bag house system. When the bag house dumps the collected calcined coke dust, it is discharged either to a waste container or back onto the coke being transported which compounds the dust load. The disposal is difficult, cumbersome and wasteful of an otherwise useful product whereas return of collected dust increases the likelihood of its objectionable release to the outside atmosphere.

Patents have described the use of aqueous or asphalt emulsions and surface active agents such as ethoxylated alkylphenols for dust control of various minerals including coal or fly ash and sand including: Japanese Pat. No. 53085819 utilizes an asphalt emulsion containing spent sulfide solution obtained from the pulp industry and containing a polyoxyethylene-nonylphenol ether as a dustproof material binder; Japanese Pat. No. 50040491 prevents dust erosion of coal or ore piles by the application of an asphalt emulsion and a mixture of an anionic and nonionic surfactant (polyethylene glycol nonylphenol ether) by spraying this system onto powdered coal; German Pat. No. 2002364 binds dust in coal mines with a wetting agent such as alkylphenol polyglycol ether in water; and Japanese Pat. No. 56067385 dust proofs coal, ore, fly ash, etc. by applying to particular product a mixture of a nonionic surfactant (such as polyoxyethylene alkyl ether) and a polyhydric alcohol.

Unfortunately, none of these dust control references offer a suitable solution for the recovery of fugitive dust, particularly coke dust, for today's environments. Perhaps this inadequacy is because the coke is neither mineral nor coal, both by definition and wetting characteristics. Calcined coke appears even more difficult to water wet than coke. It is believed that, unfortunately, none of the above procedures satisfactorily eliminate the fugitive (airborne) dust that tends to be recirculated within the transport shed, the dust as recirculated on the belt during transport operations, the dust that must be collected and subsequently removed to a landfill, and/or the fugitive dust which escapes into the atmosphere adjacent to the loading system as a pollutant.

It is therefore an object of the invention to provide a process for recovery of fugitive dust, particularly that derived from calcined coke, and provide a method for collection of the fugitive dust into a useful product.

Other objects will be apparent from the disclosure of this invention which follows hereafter.

SUMMARY OF THE INVENTION

It has been discovered that the addition of a water-wetting agent, preferably a polyoxylated nonyl phenol ether containing about 10 moles of ethylene oxide for each mole of nonyl phenol, to the fugitive calcined coke dust with sufficient water to achieve an optimum moisture content for the calcined coke dust, followed by the addition of a binder such as an asphalt emulsion and thereafter mixing of said dust, water and binder provides encapsulated fugitive dust which agglomerates as balls having sufficient compressive strength to retain their physical integrity during subsequent transport.

Thus, in accordance with this invention, there is provided a method for recovering fugitive dust from particulate solids comprising the steps of (a) collecting fugitive dust released by the particulate solids; (b) converting said fugitive dust to water-wetted moist dust; (c) encapsulating said moist dust by admixture with a binder; and (d) recovering encapsulated fugitive dust as agglomerated nondusting particles or balls.

Further, in accordance with a preferred form of this invention, there is provided a method of encapsulation of fugitive calcined coke dust comprising first adding at least a water-wetting amount of a wetting agent for the dust and sufficient water to moisten a quantity of calcined coke dust to said quantity and thereafter admixing an encapsulating and an agglomerating or balling amount of an asphalt emulsion to said moistened quantity of calcined coke dust and recovering agglomerated balls of encapsulated calcined coke dust, said amounts based on the weight quantity of said dust.

Also, in one of its preferred embodiments, the object of the invention is met by the steps of prewetting fugitive calcined coke dust with 1 to 3 percent by weight of a polyethoxylate nonyl phenol having preferably 10 moles of ethylene oxide for each mole of nonyl phenol, enhancing the surface water-wetting of the calcined coke dust by means of radial shearing forces and in the presence of water in an amount sufficient to moisten said dust, treating the wetted calcined coke dust with an asphalt emulsion in an amount sufficient to provide the dust with from 2 to 5, preferably 2.5 to 4, weight percent of asphalt and thereafter forming, such as by mixing, kneading or folding said treated dust, compacted agglomerated balls of asphalt encapsulated calcined coke dust whereby said balls have a compressive strength of at least 5 psi and are nonfriable.

DETAILED DESCRIPTION OF THE INVENTION

As earlier discussed, the generation and subsequent dispersion/distribution of fugitive dust results in serious to catastrophic problems for a wide diversity of industrial processes and activities ranging from mining operations, cereal and food production and processing, soap and detergent manufacture, plastics manufacture, and petroleum refinery operations. The teachings of this invention are applicable to any situation involving the removal (including collection) of fugitive dust. The invention should find its preferred utilization in any process involving the generation of fugitive mineral and/or carbonaceous dust such as that dust which results from the crushing and/or sizing of potash, copper slag, phosphate rock, coal, green coke, and calcined coke.

The process of the invention applies to the handling of bulk airborne, i.e., fugitive, dust which has been removed from the air, collected in bulk and modified into a form which is no longer fugitive as by encapsulation with a binder of the fugitive dust. This change is realized by the embodiment described herein by the steps of adding a water-wetting agent for the fugitive dust and water to the fugitive dust to produce water-wet and moistened dust no longer having the fugitive property and thereafter encapsulating the water-wet and moistened dust with a binder (optimally asphalt for the calcined coke dust) which then preferably is turned into agglomerate spheres or similar shaped structures consisting essentially of dust, binder, water and small amounts of water-wetting agent.

As earlier indicated, the fugitive dust which is most difficult to remove is that from calcined coke. Petroleum coke, the precursor of calcined coke, is a hard, porous, glistening material, varying in color from slate-gray to black, left as the solid residue from the destructive distillation of petroleum hydrocarbons. In appearance it is similar to the so-called by-product coke made from coal. There are two types of petroleum coke, namely, that produced in coking stills and that formed in cracking operations.

From a chemical point of view, petroleum coke is to be regarded not as an elementary form of carbon but as a mixture of hydrocarbons containing high percentages of carbon and small percentages of hydrogen. Needle coke is a premium petroleum coke especially suited for graphite production. It is made by delayed coking of low sulfur, highly aromatic heavy oil obtained from catalytic or thermal cracking. This is the world's main source of graphite for carbon electrodes used in aluminum manufacture with a value up to $1/kg on a sponge-like surface and an inclination to dust upon impact with another body. For these applications, the green needle coke is further processed by calcining to remove volatiles and increase the coke density. The green coke is heated in a rotary-kiln calciner to 1000°–1100° C., which gives product having a real or skeleton density of over 2, compared to 1.5 for the green coke and increased fragility.

The wetting agent will be selected in order to realize the desired water-wetting level and rate for the fugitive dust to be recovered, mixed with binder and encapsulated into agglomerate balls. For example, it has been found that a polyethoxylated nonylphenol having about 10 moles of ethylene oxide per mole of nonylphenol is a highly effective water-wetting agent for fugitive calcined coke dust and particularly so when used in amounts ranging from about 1 to 3 weight percent based on the weight of the dust. Alternatively, if the fugitive dust was mineral with a clay content, one might use a cationic organic polymer such as poly(dimethyldiallyl ammonium chloride) as the water-wetting agent of choice. Alternatively, if the fugitive dust contained a substantial quartz content, a preferred water-wetting agent would again be a cationic polyelectrolyte such as poly(2-methyl-5-vinylpyridinium chloride) or butyl methacrylate-2-methyl-5-vinylpyridinium chloride copolymer used in similar amounts.

The water-wetted fugitive dust is as noted converted into the moistened state by admixture with sufficient water to provide an "optimum moisture content" as commonly used in soil studies. In this moistened state of optimum moisture content, the dust mixture is plastic and cohesive and not crumbly or fluid. Usually the water added will be in the range of 0.5 to 2.5, preferably 1 to 2 weight parts, of water per weight part of fugitive dust.

The binders used for encapsulation of the dust must have the properties of mixing well with the water-wetted dust, provide with the dust a mixture with the resultant rheological properties appropriate for recovery of the encapsulated dust such as suitable viscosity, coherence, tackiness, etc. and must not be deleterious to the use intended for the encapsulated dust. A highly useful binder is asphalt used herein in the example of this invention is an oil-in-water emulsion. The binder is generally used in an amount ranging from 2 to 5, preferably 2.5 to 4, wt. % based on the weight of the dust since amounts outside this range are believed to not provide the useful rheological properties to the encapsulated dust.

In describing this invention hereafter, the removal of the fugitive dust from particulates will be exemplified by the removal and recovery of fugitive calcined coke dust from calcined coke resulting from the transport of calcined coke from storage to loading dock which transport is carried out under confinement such as an enclosed building or loading shed.

The usual practice for refineries which produce green coke from refinery bottoms and subsequently calcine the green coke is to thereafter transport the calcined coke in a closed handling system so as to avoid contamination of the product and release of the dust to the ambient environment. The calcined coke is brittle and friable so that it readily breaks and dusts particularly when moved from storage to the vessel (or vehicle) used to convey the coke to the customer. A series of inclined conveyors are used between storage and the loading dock. Typically, about 5% of the conveyed coke ends up as fugitive dust captured at the bag house where it is collected in a hopper and thereafter disposed of by bagging and removal to a dump or returned to calcined coke being moved with the possibility that it can be in part loaded into the transport vessel. The former procedure of collecting and discharging to the dump is economically costly. The latter approach of discharging it back onto the loading belt and at all bulk transfer points compounds or increases the volume of dust and reduces the efficiency of the recovery system. Further, this fugitive dust frequently exits into the atmosphere as an environmentally hazardous pollutant.

The water-wetting agent which has been found useful to wet the fugitive calcined coke dust should have an HLB between 10 and 16 and preferably between the range of 12 to 14 with 13 being the most preferred. The HLB refers to the so-called "Atlas HLB System" which is described in a publication entitled, *The Atlas HLB System,* 4th printing, published by Atlas Chemical Industries, 1963. The preferred nonionic wetting agent tends to be within the middle of the HLB scale and therefore has both hydrophilic and hydrophobic properties. The preferred nonionic wetting agent is nonylphenol which has been reacted with 10 moles of ethylene oxide per mole of nonylphenol. The nonionic agent is used in an amount sufficient to water-wet the surface of the calcined coke dust which amount has been found to be in the order of at least about 1, generally 1 to 3 weight percent, based on the weight of the dust.

In addition to the wetting agent, it is necessary to have sufficient water present to make the wetted calcined coke dust moist, preferably of about an optimum moisture content. This amount ranges from about 0.5 to 2.5 parts by weight per weight part of the dust. The wetting agent and the water are introduced onto the surface of the calcined coke dust by first spraying the aqueous solution of nonionic wetting agent onto the coke dust and thereafter moving the wetted calcined coke dust through a screw conveyor whereby in a short period of time the coke dust surfaces are wetted at a sufficient level to provide for the encapsulation of the coke dust by the asphalt. A suitable asphalt emulsion contains from 60 to 65 weight percent asphalt solids in an oil-in-water emulsion stabilized by means of a cationic emulsifier such as Asphalt Emulsion Grade CSS-1 sold by Reed and Graham of San Jose, Calif. and modified by the addition of from 0.1 to 1 wt. % of the wetting agent, preferably the water-wetting agent set forth above. After introduction of the asphalt emulsion into the chamber, the calcined coke dust now wetted and moistened is admixed with the asphalt emulsion as the admixture moves along the 8 to 10 meter screw conveyor, the screw of which has been modified to discharge the asphalt encapsulated dust as agglomerate balls having diameters ranging from 1 to 4 cm. The asphalt is introduced in an amount appropriate to produce the encapsulated dust agglomerate balls and preferably admixed with the water-wetted dust at a temperature of from 20° to 50° C.

EXAMPLE

The following description is illustrative of the practice of this invention: The loading of a cargo ship with calcined coke is carried out at an average rate of 14,500 kg/hour. Such a loading generates an average of 600 kg of fugitive calcined coke dust which is collected at the bag house and thereafter conveyed through a 3-meter long screw conveyor to its discharge end. Prior to treatment, according to this invention, the output of the conveyor is slightly densified fugitive coke dust which is readily airborne.

The screw conveyor is modified into a muellered screw configuration (installation of baffles on the shank of the conveyor and slotting of the screw to produce a forward/backward/forward movement of the dust to produce complete wetting of the dust and formation of the balls) prior to practice of this invention.

A water-wetting aqueous solution containing 0.8 wt. % of the nonionic wetting agent obtained from the reaction of 10 moles of ethylene oxide for each mole of nonyl phenol is sprayed onto the dust at the head region of the modified screw of the conveyor. Thirty to forty-five cm downstream, the asphalt emulsion consisting of 65 wt. % asphalt, 0.2 wt. % of the ethoxylated nonylphenol wetting agent, 0.1 wt. % of cationic emulsifier and the remainder about equal amounts of water and oil is sprayed onto the water-wetted, moist calcined coke dust. The collected dust being treated by passage through the screw conveyor moves at a rate of 600 kg/hour and the application rate for the water-wetting aqueous solution is 820 liters/hour and for the asphalt binder emulsion is 27 liters/hour. By the time the mixture reaches the discharge end of the screw conveyor, the asphalt encapsulated dust (a dust from friable materials) is in the form of agglomerate balls, which balls are nonfriable and can be dumped onto the outbound cargo belt.

It will be understood of course that modifications can be made in the preferred embodiment of the present invention as described hereinabove without departing from the scope and purview of the appended claims.

What is claimed is:

1. A method of encapsulation of fugitive carbonaceous dust comprising first adding at least a water-wetting amount of a wetting agent for the dust and sufficient water to moisten a quantity of carbonaceous dust to said quantity of carbonaceous dust and thereafter admixing an encapsulating amount of an asphalt emulsion with said moistened quantity of carbonaceous dust and recovering balls of agglomerate encapsulated dust, said asphalt comprising from 2 to 5 wt% of said dust.

2. A method according to claim 1 wherein said wetting agent is added as a dilute aqueous solution and the admixing is carried out as soon as said dust is water-wetted.

3. A method according to claim 1 wherein from 1 to 3 weight percent of the wetting agent is added as an aqueous solution with an amount of water sufficient to provide about the optimum moisture content of said water in said dust.

4. A method according to claim 1 wherein said binder is obtained from an emulsion and is asphalt in an amount of from 2 to 5 weight percent based on the weight of the dust.

5. A method according to claim 3 wherein the wetting agent is a polyethoxylated nonylphenol containing 10 moles of ethylene oxide for each mole of nonylphenol, said emulsion provides from 2 to 5 weight percent of asphalt and said amount of water ranges from 0.5 to 2.5 weight parts per weight part of dust.

6. A method as defined in claim 1 wherein the water wetting agent has an HLB between 10 and 16.

7. A method as defined in claim 1 wherein the asphalt emulsion comprises water external emulsion.

8. A method as defined in claim 7 wherein the emulsion comprises from 60 to 65 weight percent asphalt.

9. A method as defined in claim 1 wherein the balls are from 1 to 4 cm in diameter.

10. A method as defined in claim 9 wherein the balls have a compressive strength of at least 5 psi.

11. A method as defined in claim 1 wherein the admixing step is carried out at a temperature of between 20° C. and 50° C.

12. A method as defined in claim 1 wherein the carbonaceous dust is calcined coke dust.

* * * * *